US008028829B2

(12) United States Patent
Arnold et al.

(10) Patent No.: US 8,028,829 B2
(45) Date of Patent: Oct. 4, 2011

(54) LAUNDRY FRAGRANCE DISPERSION SYSTEM USING TUMBLE SHEETS

(75) Inventors: Douglas J. Arnold, Franklin, WI (US); Jeffrey G. Maxon, Waldo, WI (US)

(73) Assignee: Kleen Test Products Corporation, Port Washington, WI (US)

( * ) Notice: Subject to any disclaimer, the term of this patent is extended or adjusted under 35 U.S.C. 154(b) by 0 days.

(21) Appl. No.: 12/470,934

(22) Filed: May 22, 2009

(65) Prior Publication Data

US 2010/0294678 A1 Nov. 25, 2010

(51) Int. Cl.
*B65D 69/00* (2006.01)
*B65D 71/00* (2006.01)

(52) U.S. Cl. ..... 206/229; 206/233

(58) Field of Classification Search ..... 206/229, 206/233, 459.5; 510/513–537
See application file for complete search history.

(56) References Cited

U.S. PATENT DOCUMENTS

| | | | | |
|---|---|---|---|---|
| 3,980,203 | A * | 9/1976 | Dearling | 221/96 |
| 4,448,704 | A * | 5/1984 | Barby et al. | 15/104.93 |
| 4,627,936 | A * | 12/1986 | Gould et al. | 15/104.93 |
| 4,666,621 | A * | 5/1987 | Clark et al. | 15/104.93 |
| 4,931,201 | A * | 6/1990 | Julemont | 15/104.93 |
| 5,439,104 | A * | 8/1995 | Wolska-Klis | 206/233 |
| 2002/0063075 | A1 * | 5/2002 | Morita | 206/387.1 |

* cited by examiner

*Primary Examiner* — Bryon P Gehman
*Assistant Examiner* — Rafael Ortiz
(74) *Attorney, Agent, or Firm* — Boyle Fredrickson, S.C.

(57) ABSTRACT

A laundry treatment system includes a carton holding a free-standing fragrance spray bottle of fragrance together with unscented laundry treatment sheets. The fragrance spray bottle may be used to apply fragrance to the sheets immediately before use by the consumer so as to enable dispersion of the fragrance among the clothing during a laundry cycle. The box may include apertures for supporting multiple bottles to allow the consumer to change or mix fragrances or apply no fragrance at the time of drying.

14 Claims, 3 Drawing Sheets

LAUNDRY FRAGRANCE DISPERSION SYSTEM USING TUMBLE SHEETS

BACKGROUND

The present invention relates to systems for the dispersion of fragrance in laundry during the drying cycle of a dryer and in particular to a dispersion system using tumble sheets such as fabric softener sheets to facilitate the dispersion of the fragrance.

A wide variety of laundry products include perfumes for imparting a pleasant fragrance to clothing and/or other textiles, such as towels, sheets, etc. Such perfumes may be carried in laundry detergents, bleaches, or softeners to be dispersed during the washing process of a washing machine or added to "tumble sheets" during the drying cycle of a dryer. Tumble sheets are fabric-like sheets that readily intermingle with clothing to disperse laundry treatment materials including antistatic agents, wrinkle reducing agents, stain repellents, odor neutralizers, softening agents, fabric refreshers, soil shielding/soil releasing agents, ultraviolet light protection agents, water repellency agents, insect repellency agents, and dye transfer inhibitors. These laundry treatment materials often have a waxy consistency that helps retain the treatment materials on the tumble sheets for a period of time to ensure good dispersion of these materials on the laundry items during the drying cycle.

Some perfume agents including those associated with freshness are highly volatile and thus may be easily lost during the high temperature manufacture of the tumble sheet. U.S. Pat. No. 6,352,969 recognizes that the loss of these "high note" fragrance components may be reduced by altering the normal manufacturing process in which the perfumes are mixed with other laundry treatment components and applied at high temperature to the tumble sheet. Instead, the teachings of this patent are to apply the perfume after the tumble sheet is coated with other laundry treatment components immediately before it is cut and packaged. It was unexpectedly found that the later-added perfume is well absorbed by the tumble sheet when added at a later point in the manufacturing process.

SUMMARY OF THE INVENTION

The present invention permits further delay of the introduction of the fragrance to the tumble sheet to a point immediately before use of the tumble sheet in the laundry by providing a convenient kit for the consumer including unscented tumble sheets and a fragrance spray bottle. The kit provides the consumer with freedom to select which fragrance and how much fragrance to introduce to their clothes while preserving the good dispersion properties and other laundry treatment aspects of the tumble sheet. By delaying the introduction of fragrance to the tumble sheets, the packaged sheets may be used also for times when no scent is desired. Further, by delaying the introduction of fragrance to the tumble sheets, high note fragrance components are not lost during prolonged storage of the package in a store or warehouse.

Specifically, the present invention provides a carton containing therein a stack of individual, separate, unscented tumble sheets in a first compartment, the tumble sheets coated with a laundry treatment substance selected from the group consisting of: antistatic agents, wrinkle reducing agents, stain repellents, odor neutralizers, softening agents, fabric refreshers, soil shielding/soil releasing agents, ultraviolet light protection agents, water repellency agents, insect repellency agents, and dye transfer inhibitors, and containing in a second compartment a fragrance spray bottle holding fragrance applicable to the individual tumble sheets to be retained thereby for dispersion in clothing when the tumble sheet is intermixed with the clothing during drying of the clothing in a dryer, the compartments providing an access flap closable to retain the tumble sheets and fragrance spray bottle within the compartments.

It is thus a feature of at least one embodiment of the invention to provide for greater consumer control of fragrance type and amount applied to laundry during drying together with the beneficial dispersion and laundry treatment features of a tumble sheet. It is a further feature of at least one embodiment of the invention to better preserve high note fragrance components.

The carton may further include a series of openings aligned with the second compartment to expose the fragrance spray bottle therethrough.

It is thus an object of the invention to permit ready identification of a fragrance type as indicated by the fragrance spray bottle when different fragrances are packaged with the tumble sheets.

The openings in the carton may further be commensurate with a cross-section of the fragrance spray bottle so that the fragrance spray bottle and/or the spray bottle alongside additional fragrance spray bottles may be inserted in an opening after removal from the carton to support the fragrance spray bottles in an upright configuration.

It is thus a feature of at least one embodiment of the invention to provide a convenient treatment station that makes it both practical and convenient for point-of-use fragrance application to a tumble sheet.

The bottle may have container walls of a transparent, tinted plastic allowing inspection of a level of fragrance contained therein, the tint selected according to a predetermined relationship between tint and fragrance.

It is thus an object of the invention to provide a simple method of distinguishing among colorless fragrances preferred to avoid staining of clothing and to provide a simple and attractive method of visually distinguishing among fragrance types both before and after sale of the product. The colored bottle may readily indicate the fragrance type through the openings in the carton.

The carton may provide outer walls forming generally a rectangular parallelepiped surrounding a matching volume and wherein the first and second compartments may be formed by a spanning wall dividing the volume into the first and second compartments.

It is thus a feature of at least one embodiment of the invention to provide a simple method of creating separate compartments to prevent crushing of the tumble sheets and to appropriately support and display the fragrance spray bottle while further reducing outward bowing of the broad package face, particularly when intercut with apertures.

The carton may provide a first rectangular wall sized to support a base of the stack formed by a lower most tumble sheet such that the base extends substantially an entire width of the first rectangular wall and to support adjacent to the stack a side wall of the fragrance spray bottle, a longest dimension of the fragrance spray bottle extending along a line across the width of the first rectangular wall; the carton provides perpendicularly extending sidewalls along the periphery of the first rectangular wall joined by a second rectangular wall substantially parallel to and of equal dimensions to the first rectangular wall, and spanning a wall extending upward from a line separating the stack and the bottle between the first and second rectangular walls, the upstanding sidewalls and spanning wall extending by an amount substantially equal to the height of the stack.

It is thus a feature of at least one embodiment of the invention to permit a compact carton dimension that promotes a large presentation front surface and may stably rest on one side with proper support of the tumble sheets.

The carton may include printed indicia on the first rectangular wall denoting a rotational orientation of the first rectangular wall when the carton is resting on an upstanding sidewall such that the stack is positioned below the fragrance spray bottle.

It is thus a feature of at least one embodiment of the invention to promote carton facings that maximize product visibility.

The openings may be in the first rectangular face.

It is thus a feature of at least one embodiment of the invention to provide exposure of the fragrance spray bottle on the same surface providing greatest presentation value to the purchasing consumer.

The spanning wall may include tabs extending perpendicularly to a line along the width of the rectangular base in between the orifices.

It is thus a feature of at least one embodiment of the invention to provide large apertures while supporting and reinforcing the interstitial material.

The spanning wall may be attached to only one of the first and second rectangular walls.

It is thus a feature of at least one embodiment of the invention to permit simplified fabrication of the carton.

The spanning wall may include a portion extending along and abutting the first rectangular wall and extending beneath the fragrance spray bottle when the fragrance spray bottle is within the second compartment.

It is thus a feature of at least one embodiment of the invention to provide reinforcement of the fragrance spray bottle compartment.

These particular features and advantages may apply to only some embodiments falling within the claims and thus do not define the scope of the invention.

DETAILED DESCRIPTION OF THE PREFERRED EMBODIMENT

Figure 1:
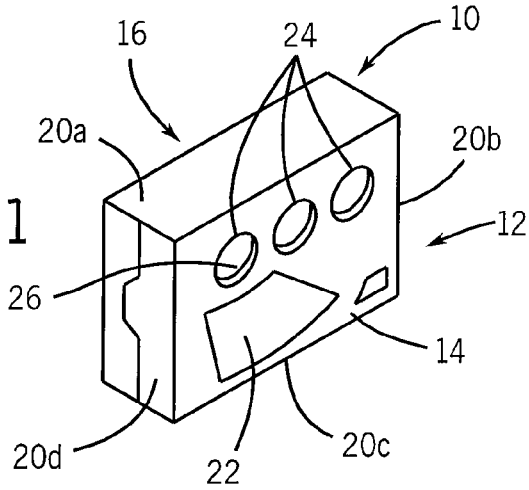
FIG. 1 is a perspective view of the carton of the present invention when displayed on a typical shelf facing with its broad face forward.

Referring now to FIG. 1, the present invention may provide a fragrance dispersal system 10 including a carton 12, for example, of coated cardboard stock, holding other components of the dispersal system 10 for retail sales. The carton 12 may be a generally rectangular parallelepiped having a rectangular front wall 14 and corresponding rear wall 16 in parallel opposition separated by perpendicular sidewalls 20*a-d*. The rectangular front wall 14 and rear wall 16 are the largest walls of the carton 12 and support on them printed point of sale information 22, for example, indicating the product, the brand, its purpose, and its benefits. In a retail facing, the carton 12 made be set stably on sidewall 20*c* to prominently display the information on front wall 14.

A series of apertures 24 may be die cut in the front wall 14 near its upper edge adjacent to sidewall 20*a*, the apertures 24 preferably being equal sized circles whose centers are displaced in a line along a width of the front wall 14 disposed generally horizontally during retail display. A fragrance spray bottle 26 resting horizontally within an internal compartment (to be described below) is visible through the apertures 24.

In a preferred embodiment, the front wall 14 of the carton may be approximately 5½ inches high and 7 inches wide with the sidewalls 20 holding the front wall 14 and rear wall 16 approximately 1½ inches in separation.

Figure 2:
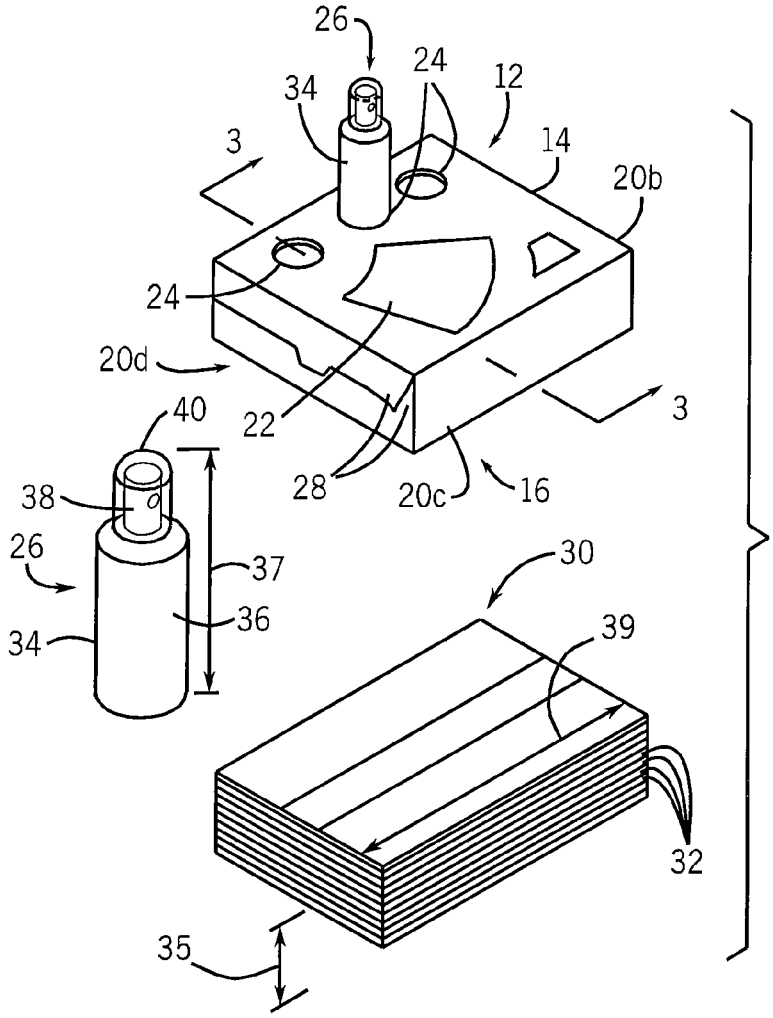
FIG. 2 is a perspective view of the carton of FIG. 1 in use as a laundry treatment center showing the contained stack of tumble sheets and fragrance spray bottle removed through a side access flap and with one fragrance spray bottle positioned in the carton as a holder.

Referring now also to FIG. 2, the fragrance spray bottle 26 may be a conventional mechanical pump sprayer including a cylindrical reservoir 34 holding a fragrance 36 sealed therein by a spray mechanism 38 the upper operator of which is contained within a protective cap 40. In one embodiment, the fragrance spray bottle reservoir 34 is constructed of a transparent, tinted thermoplastic polymer allowing direct viewing of the height of the fragrance 36 within the reservoir 34 while also announcing the type of fragrance by color of the tinted polymer so that different colors of fragrance spray bottles 26 may be placed into different cartons 12 on a seasonal or occasional basis with different fragrances 36. So, for example, a purple bottle may denote a first type of fragrance 36 and a pink bottle a second type of fragrance 36 while permitting the fragrances 36 to be untinted. The fragrance 36 may include the fragrance itself and a carrier such as water and/or another solvent to assist in incorporation of the fragrance into the materials of the sheets 32. Although described and shown as a tinted bottle, the bottle may alternatively be clear plastic, be labeled, etc.

The carton 12 also holds a stack 30 of folded, unscented tumble sheets 32 in addition to the fragrance spray bottle 26. The sheets may, for example, be a nonwoven polyester material or the like known in the art and pre-coated with laundry treatment materials including one or more of: antistatic agents, wrinkle reducing agents, stain repellents, and dye transfer inhibitors. Although shown and described as a stack 30, the tumble sheets may be provided in alternative configurations such as on a roll with perforations allowing easy separation of the tumble sheets, etc.

The stack 30 of sheets 32 will generally have a height 35 equal to the separation of the front wall 14 and rear wall 16 by the sidewalls 20 and will have a width 39 (described above) essentially equal to a width of the front wall 14 and rear wall 16 measured in a direction parallel to sidewalls 20*c* and 20*a*. The fragrance spray bottle 26 defines a height 37, measured from the base on which it rests during normal use to the top of the protective cap 40, that is preferably equal to or less than the width 39 of the stack 30 measured along the stack's longest dimension. In one embodiment, the sheets may have an unfolded dimension of approximately 6½"×9" and a folded dimension of 6½"×3.5" where the 6½" is the width 39.

During use of the product, the carton 12 may be placed flat upon rear wall 16 so that the apertures 24 face upward from the front wall 14 to receive the reservoir 34 of the fragrance spray bottle 26 whose circular cross-section in width matches the size of the apertures 24. In this way multiple fragrance spray bottles 26 may be collected and stably supported to be readily used by the consumer for laundry applications. The consumer may remove an individual sheet 32 from the stack 30 and spray the unfolded sheet 32 with fragrance 36 using the fragrance spray bottle 26. The spraying is conducted substantially at room temperature at a time many hours if not weeks after manufacture of the sheets 32. The fragrance 36 may be adsorbed by the material of the sheet 32 which is then promptly placed into laundry in the dryer to act as a dispersal agent for the fragrance 36 distributing it evenly among the laundry. The multiple apertures 24 allow different fragrance bottles to be collected and stored in the original carton 12 as additional product is purchased with different fragrances. Although the bottle 26 and apertures 24 are shown and described herein as being circular, it should be obvious to one of ordinary skill in the art that the bottles and apertures may be in any correlating shape. Further, the apertures may be different from each other such that one type of bottle, for example having a flower shape correlating to a scent for the fragrance in that bottle fits in one type of aperture having a correlating flower shape, etc.

Figure 3:
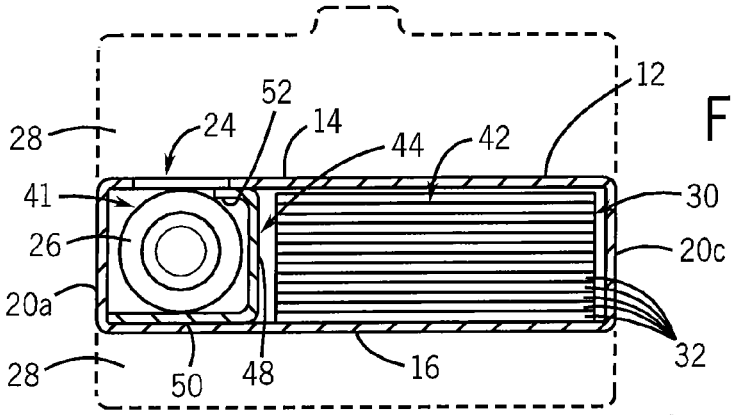
FIG. 3 is a cross-section taken a long line 3-3 of FIG. 2 showing orientation of the fragrance spray bottle and laundry sheets within the carton of FIG. 2.

Referring now to FIGS. 2 and 3, one sidewall 20*d* may provide resealable flaps 28, for example, using a tab and slot arrangement well known in the art, to open and reveal a first compartment 41 holding the fragrance spray bottle 26 for removal through the open flaps 28 and a second compartment 42 holding the stack 30 for removal through the open flaps 28. Compartment 41 and 42 may be formed in part by a spanning wall 44 extending from the front wall 14 to the rear wall 16 of the carton 12 generally parallel to the sidewalls 20*a* and 20*c*.

Figure 5:
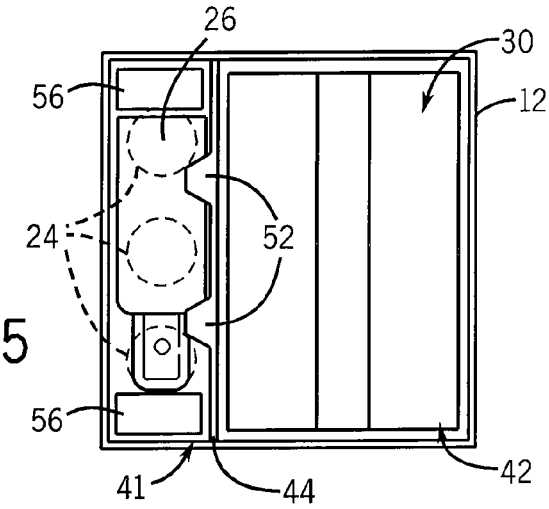
FIG. 5 is a top plan view of the carton of FIG. 4 showing the use of spacers to center the bottle within apertures in the broad face of the carton and reinforcing tabs between those orifices attaching the spanning wall to the front face of the carton.
Figure 6:
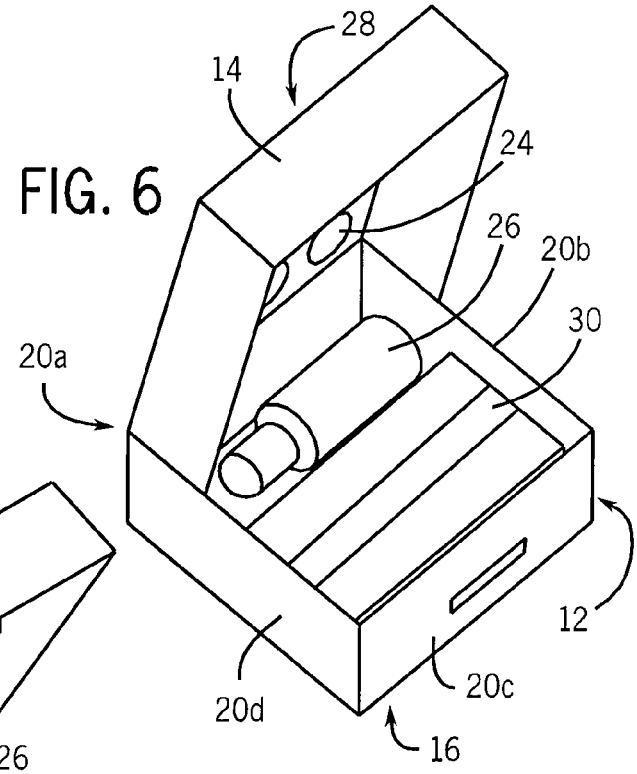
FIG. 6 is a perspective view similar to that of FIG. 2 showing an alternative embodiment wherein the tumble sheets and fragrance spray bottle are in a single compartment.

Referring now to FIGS. 3, 5 and 6, the spanning wall 44 may comprise an L-shaped cardboard member having a panel 48 extending generally parallel to sidewalls 28*a* and 20*c* attached at its lower edge to a stabilizing flange 50 extending perpendicularly from the panel 48. The stabilizing flange 50 may abut an upper surface of rear wall 16 between the fragrance spray bottle 26 and the rear wall 16. An upper edge of the panel 48 includes two tabs 52 extending perpendicularly therefrom along the front wall 14 to fit between the apertures 24 and to be glued to the underside of front wall 14 providing reinforcement between the apertures 24 as shown in FIG. 5.

Figure 4:
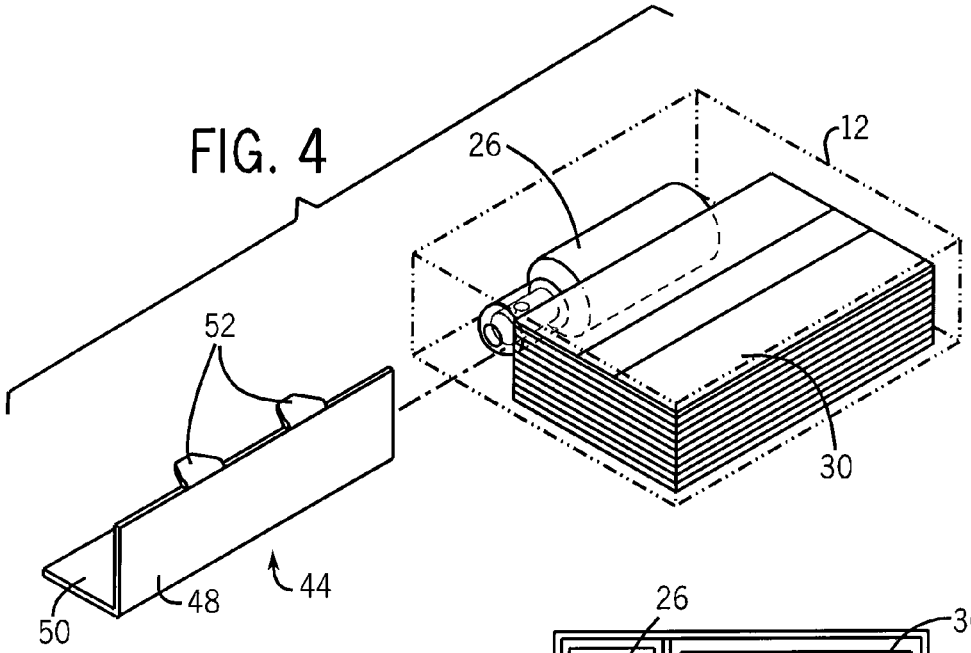
FIG. 4 is an exploded view in partial phantom of the carton of FIG. 3 showing a spanning wall used to form compartments for the bottle and stack of tumble sheets.

Referring to FIGS. 4 and 5, compartments 41 and 42 formed by the spanning wall 44 allow the stack 30 to be placed in side-by-side configuration with the fragrance spray bottle 26 where the height 37 of the fragrance spray bottle 26 is aligned with the width 39 of the stack 30 so as to provide a slim form factor to carton 12 of compact volume providing good display area. The spanning wall 44, by separating the stack 30 from the fragrance spray bottle 26, prevents deformation of the sheets 32 of the stack 30 by the weight of the fragrance spray bottle 26 during shipping, handling, or while displayed in the position shown in FIG. 1. Optionally the spanning wall 44 may be glued only to the top of the front wall 14 by tabs 54, being held to the rear wall 16 by the pressure of the fragrance spray bottle 26 constrained between the front wall 14 and rear wall 16. The spanning wall 44 may act as a tensile member preventing outward bowing of the front wall 46 at the weak section of the apertures 24.

Spacers 56 may be placed at either or both ends of the fragrance spray bottle 26 so as to center the fragrance spray bottle 26 within the compartment 41.

Generally the weight of the sheets 32 in the stack 30 will provide a low center of gravity providing suitable stability for the carton 12 in the orientation shown in FIG. 1 with the apertures 24 and fragrance spray bottle 26 near the top of the carton. According to alternative embodiments, the sheets and bottle may be positioned on the side of the bottle, etc. to provide any of a number of various configurations within the scope of the present invention to implement the functionality described herein.

As noted above, it is expected during use the consumer will use the fragrance spray bottle 26 immediately before drying clothes to dust the tumble sheet 32 with fragrance placing the scent achieved within the clothing during the drying process. The remaining sheets 32 are stored within the carton 12 with the fragrance spray bottle 26 retained in the aperture 24. As additional sheets 32 may be purchased with different fragrances, those bottles will be added to the remaining apertures 24 and the sheets 32 used to replace the sheets in the carton 12 as the latter are depleted.

Referring now to FIG. 6, in an alternative embodiment, the sidewall 44 may be removed such that the stack 30 of tumble sheets 32 are positioned in a single compartment with the fragrance spray bottle 26. Although shown according to a particular packaging configuration, it should be understood that the fragrance bottle 26 and stack 30 may be positioned in a variety of configurations.

Figure 7:
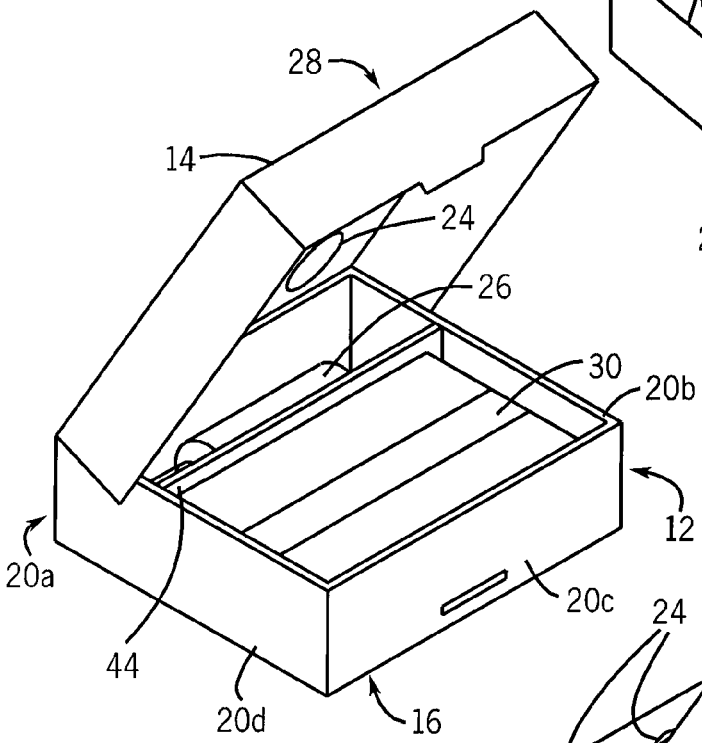
FIG. 7 is a perspective view similar to that of FIG. 2 showing an alternative embodiment wherein the broad face of the carton forms the access flap.

Referring now to FIG. 7, in an alternative embodiment, the access flap 28 may be moved from the sidewall 20*d* and implemented instead by the front wall 14 of the carton 12 which may hinge upward about its connection point at sidewall 20*a* to provide access to both the fragrance spray bottle 26 and the stack 30 of sheets 32 through the front wall 14. A locking tab mechanism of a type known in the art may be used to hold the flap 28 down when the carton 12 is used to retain the fragrance spray bottles 26, when the latter are placed through the apertures 24 as shown in FIG. 2. In this configuration, the tabs 52 on an attachment of the spanning wall 44 at its upper edge are eliminated and the leg 50 glued to the inside of the rear wall 16.

Figure 8:
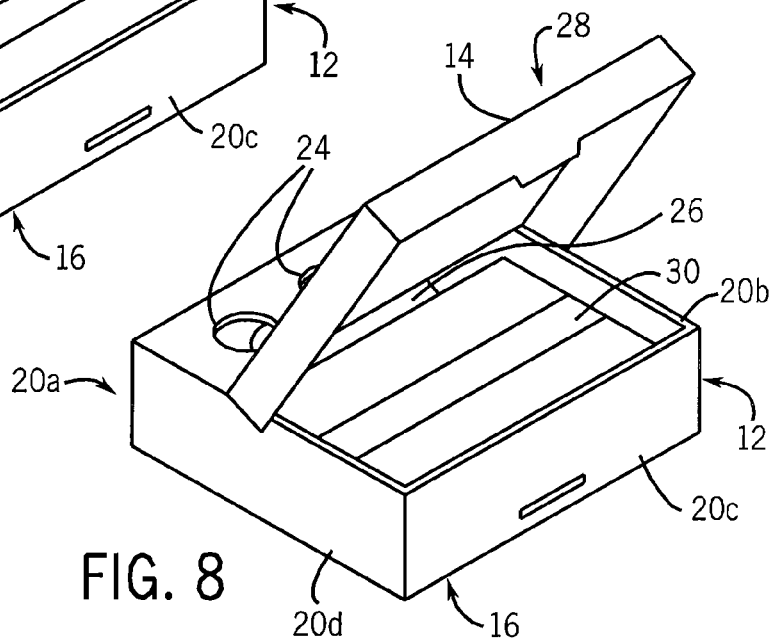
FIG. 8 is a perspective view similar to that of FIG. 2 showing an alternative embodiment wherein only a section of the broad face of the carton forms the access flap.

Referring now to FIG. 8, in another alternative embodiment, the "hinge" portion of the access flap 28 may be moved from its connection point at sidewall 20*a* to a point along the extent of sidewalls 20*b* and 20*d* to provide access to only the stack 30 of sheets 32 through the front wall 14. The fragrance spray bottle 26 may, according to an exemplary embodiment, be accessed by a separate opening along or formed by one of sidewalls 20*b* and 20*d*.

The present invention has been described in terms of the preferred embodiment, and it is recognized that equivalents, alternatives, and modifications, aside from those expressly stated, are possible and within the scope of the appending claims.

We claim:

1. A carton, comprising a stack of individual unscented tumble sheets, the tumble sheets coated with a laundry treatment substance configured to be released during a clothes drying operation selected from the group consisting of: antistatic agents, wrinkle reducing agents, stain repellents, odor neutralizers, softening agents, fabric refreshers, soil shielding/ soil releasing agents, ultraviolet light protection agents, water repellency agents, insect repellency agents, and dye transfer inhibitors;

a fragrance spray bottle containing a fragrance solution that provides fragrance without modifying operation of the laundry treatment substance, the fragrance solution applicable to the individual unscented tumble sheets so that the fragrance is retained thereby for dispersion when the tumble sheets are utilized during a drying cycle of a dryer; and a fragrance spray indicia indicating the fragrance associated with the fragrance solution.

2. The carton of claim 1, including a first compartment enclosing the tumble sheets and a second compartment enclosing the fragrance spray bottle, the compartments providing at least one access flap closable to retain the tumble sheets and fragrance spray bottle within compartments.

3. The carton of claim 2, wherein the carton further includes a series of openings aligned with the second compartment to expose the fragrance spray bottle therethrough.

4. The carton of claim 3, wherein the openings are commensurate with a cross-section of the fragrance spray bottle so that the fragrance spray bottle may be inserted in an opening after removal from the carton to support the fragrance spray bottle in an upright configuration.

5. The carton of claim 2, wherein the carton provides outer walls forming generally a rectangular parallelepiped surrounding a matching volume and wherein the first and second compartments are formed by a spanning wall dividing the volume into the first and second compartments.

6. The carton of claim 5, wherein the carton provides a first rectangular wall sized to support a base of the stack formed by a lower most tumble sheet such that the base extends substantially an entire width of the first rectangular wall, and to support, adjacent to the stack, a side wall of the fragrance spray bottle, a longest dimension of the fragrance spray bottle extending along a line across the width of the first rectangular wall; the carton providing perpendicularly extending sidewalls along the periphery of the first rectangular wall joined by a second rectangular wall substantially parallel to and of equal dimensions to the first rectangular wall, and a spanning wall extending perpendicularly from a line separating the stack and the bottle between the first and second rectangular walls, the sidewalls and spanning wall extending by an amount substantially equal to a height of the stack.

7. The carton of claim 6, further including printed indicia on the first rectangular wall denoting a rotational orientation of the first rectangular wall when the carton is resting on an upstanding sidewall such that the stack is positioned below the fragrance spray bottle.

8. The carton of claim 7, wherein the carton further includes a series of openings aligned with the second compartment to expose the fragrance spray bottle therethrough and the openings are in the first rectangular wall.

9. The carton of claim 8, wherein the spanning wall includes tabs extending along and attached to the first rectangular wall in between the openings.

10. The carton of claim 5, wherein the spanning wall is positioned perpendicular to an upstanding sidewall such that the stack is positioned proximate to the fragrance spray bottle.

11. The carton of claim 5, wherein the spanning wall is attached to only one of the first and second rectangular walls.

12. The carton of claim 5, wherein the spanning wall includes a portion extending along and abutting the first rectangular wall and extending beneath the fragrance spray bottle when the fragrance spray bottle is within the second compartment.

13. The carton of claim 1, wherein the bottle includes container walls of a transparent, tinted plastic allowing inspection of a level of fragrance contained therein, the tint selected according to a predetermined relationship between tint and fragrance.

14. A fabric softening kit comprising:

(a) a stack of individual tumble sheets of nonwoven fabric coated with laundry treatment substance configured to be released during a clothes drying operation;

(b) a fragrance spray bottle containing a fragrance solution that provides fragrance without modifying operation of the laundry treatment substance, the fragrance solution applicable to the tumble sheets to accept the fragrance to be retained thereby for dispersion through laundry when intermixed with the laundry during drying of the laundry in a dryer;

(c) a fragrance spray indicia indicating the fragrance associated with the fragrance solution; and (d) a carton holding the tumble sheets in a first compartment and the fragrance spray bottle in a second compartment, the compartments providing an access flap closable to retain the tumble sheets and fragrance spray bottle within compartments and openable to allow access to the first and second compartments, the carton including:

(i) a first rectangular wall sized to support a base of the stack formed by a lower most tumble sheet such that the base extends substantially an entire width of the first rectangular wall and to support adjacent to the stack a side wall of the fragrance spray bottle, a longest dimension of the fragrance spray bottle extending along a line across the width of the first rectangular wall;

(ii) perpendicularly extending sidewalls along the periphery of the first rectangular wall joined by a second rectangular wall substantially parallel to and of equal dimensions to the first rectangular wall and a width of the fragrance spray bottle; and (iii) a spanning wall extending upward from a line separating the stack and the bottle between the first and second rectangular walls, the upstanding sidewalls and spanning wall extending by an amount substantially equal to a height of the stack;

wherein the first rectangular wall includes a series of openings aligned with the second compartment to expose the fragrance spray bottle therethrough and printed indicia on the first rectangular wall denoting a rotational orientation of the first rectangular wall when the carton is resting on an upstanding sidewall such that the stack is positioned below the fragrance spray bottle.

* * * * *